United States Patent [19]

Bolle

[11] Patent Number: 4,958,674

[45] Date of Patent: Sep. 25, 1990

[54] FULL MOLD CASTING PROCESS AND DEVICE

[75] Inventor: Joachim Bolle, Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 489,839

[22] Filed: Mar. 5, 1990

Related U.S. Application Data

[63] Continuation of Ser. No. 163,385, Mar. 2, 1988, abandoned.

[30] Foreign Application Priority Data

Mar. 9, 1987 [DE] Fed. Rep. of Germany ..... 3707467

[51] Int. Cl.[5] ..... B22C 9/04; B22C 15/22

[52] U.S. Cl. ..... 164/456; 164/7.1; 164/34; 164/160.1; 164/154

[58] Field of Search ..... 164/34, 35, 36, 7.1, 164/160.1, 38, 39, 154, 456

[56] References Cited

U.S. PATENT DOCUMENTS

| | | | |
|---|---|---|---|
| 3,861,447 | 1/1975 | Hondo | 164/34 |
| 4,126,176 | 11/1978 | Muller et al. | 164/160.1 |

FOREIGN PATENT DOCUMENTS

| | | | |
|---|---|---|---|
| 91533 | 10/1983 | European Pat. Off. | 164/35 |
| 1041549 | 10/1953 | France | 164/34 |
| 56-158251 | 12/1981 | Japan | 164/7.1 |
| 61-82947 | 4/1986 | Japan | 164/34 |
| 61-262445 | 11/1986 | Japan | 164/34 |
| 772686 | 10/1980 | U.S.S.R. | 164/34 |
| 2088762 | 6/1982 | United Kingdom | 164/34 |

*Primary Examiner*—Kuang Y. Lin
*Attorney, Agent, or Firm*—Dority & Manning

[57] ABSTRACT

A full mold casting process in which a complete, positive model made of a thermally decomposable material is placed in a molding box and filled with sand; the sand is hardened by tamping it in. Casting metal is poured on the thermally decomposable model and the model is decomposed by the casting heat. In order to fill up the cavities of the model and mold moldings with crucial cavities, reliably with the molding sand, the sand is subjected to either a positive or negative pressure differential during the sand-filling phase to enclose and fill the model. The filling and hardening of the sand is further assisted through the fact that simultaneous vibration of the molding box is carried out while the sand is subjected to pressure differential.

18 Claims, 2 Drawing Sheets

P2
1
2
2
2
P1
h

P2 > P1
h
0
0
ΔP

P2 > P1
h
0
0
ΔP

P2 > P1
h
0
0
ΔP

FULL MOLD CASTING PROCESS AND DEVICE

This is a continuation of application Ser. No. 163,385, filed Mar. 2, 1988, which is now abandoned.

BACKGROUND OF THE INVENTION

The instant invention relates to a full mold casting process in which a complete positive model, made of a thermally decomposable material, is placed into a molding box filled with sand. The sand is compacted by tamping it in, and the casting metal is poured on the thermally decomposable model. The model is decomposed by the casting heat. The invention includes a device for carrying out the process.

To produce castings, molds consisting of two halves are generally used. However, this division of the molds is only possible within certain dimensional tolerances, and as a consequence, defects may occur within the mold joint due to offset burrs, sand washouts, metal penetrating into the sand mold, charred portions of sand, and the like. All these defects appear on the cast and must be eliminated by grinding, stripping, knocking, sawing, or the like.

To avoid these extensive manual tasks a model is placed into a molding box with loose, dry sand in the so-called full mold casting process. To be able to remove the model, the model is made of a thermally decomposable material so that the model is decomposed by the casting heat. When an undivided model is used, a casting without burrs is produced.

It has been found, however, that not all types of models can be molded in this manner and it is especially difficult to satisfactorily embed moldings with dome-shaped cavities, such as pump housings and similar shapes, in the sand because the sand does not rise to fill these cavities. It is, therefore, a disadvantage of this known full mold casting process that such moldings cannot be molded and cast in this process but must be produced with batch cores or in the conventional molding process, in several parts. All molds in which the sand would have to rise into such cavities as well as into communicating pipes are, therefore, unusable with the known full mold casting process.

SUMMARY OF THE INVENTION

It is the object of the instant invention to improve the full mold casting process so that moldings with crucial cavities can also be molded and filled safely by the molding sand.

A further object consists in compressing the molding sand in a controlled manner.

The objects are attained through the invention in that the sand is subjected to a pressure difference in the sand filling direction during filling to enclose the model.

This is achieved preferably by subjecting the sand to negative pressure while the cavities are being filled.

The filling and hardening of the sand in the crucial cavities is especially facilitated if the sand is tamped in simultaneously as it is subjected to negative pressure.

In an advantageous further variation of the process the negative pressure is switched off only after completion of the tamping-in phase. This makes it possible to achieve reliable hardening of the sand on all sides around the molding without danger of the sand being loosened.

By introducing the negative pressure into the molding box below the casting model, preferably through the bottom of the casting box, all cavities of the casting model are completely filled with sand and the latter is compressed against the model. To obtain the desired degree of gas permeability of the sand, the negative pressure is adjusted in accordance with the sand's nature. By reducing the negative pressure as the filling level of the molding sand increases, the force counteracting the tamping-in force is gradually decreased and uniform compression is thus made possible at all filling stages. In every instance, however, the negative pressure is brought to the degree that has been determined by experience to be necessary for the enclosure of the model when the model's level has been reached. The rising of the sand in the model cavity is facilitated by the fact that the filling level of the molding sand is kept nearly constant near the model cavity to be filled until the cavity is completely filled.

The model is preferably enclosed in sand which does not include a binding agent in the sand.

The device to carry out the process is characterized in that the interior of the molding box is connected to a negative pressure device via a feeding pipe. Rapid and uniform subjection of the sand to negative pressure is obtained by surrounding the molding box with a closed circular pipeline or manifold connected through a plurality of air inlet openings to the molding box's interior and to the feeding pipe. The fact that the air outlet opening is located below the casting model ensures a particularly reliable filling of the model cavities. The air outlet openings are preferably located at the bottom of the molding box. In a further advantageous embodiment the negative pressure device is equipped with a control device.

BRIEF DESCRIPTION OF THE DRAWINGS

Embodiments of the invention are described through the drawings, where.

DETAILED DESCRIPTION OF THE DRAWINGS

Figure 1:
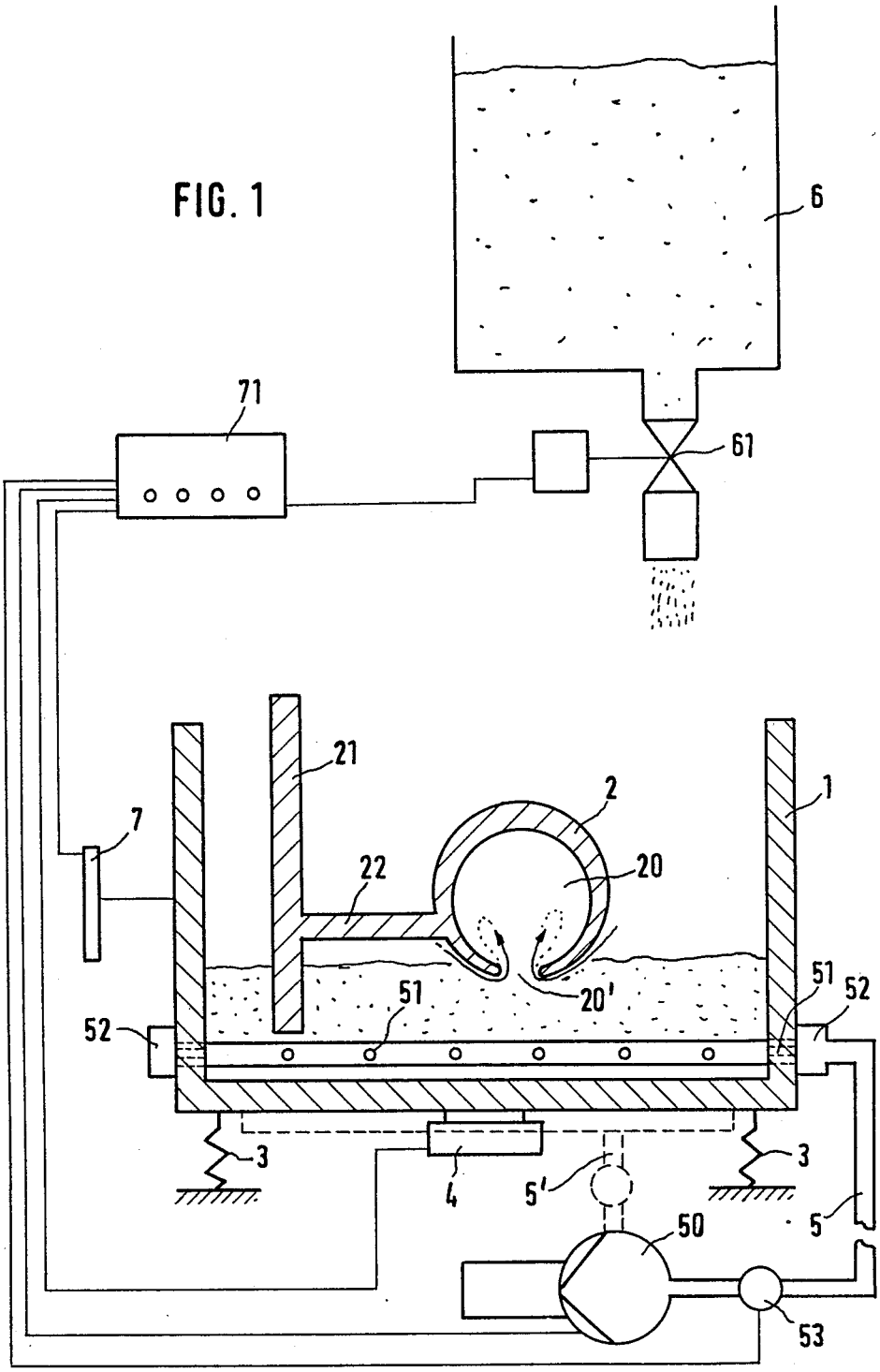
FIG. 1 shows the essential elements of a full mold casting device, schematically, in cross-section.

One or more complete positive models 2, of which FIG. 1 only shows one model with a cavity 20, are placed, in form of a grape, in a molding box 1. Model 2, the pouring pipe 21 and the runners 22 of the grape are made of a thermally decomposable material, e.g. polystyrene, and represents a cross-section through part of a radial pump housing. The molding box 1 is filled with dry sand (preferably, with sand without a binding agent). A somewhat coarser silica sand such as is generally used for molding has proven suitable. Molding box 1, which is supported by means of springs 3 so as to be capable of oscillation, is equipped with a vibrating device 4, by means of which the sand is tamped in and is thus compressed.

A pressure difference is created in the filling direction in the molding box during filling, by applying excess or positive pressure at the top of the molding box or, preferably, by means of a negative pressure device 50. Negative pressure device 50 is connected to the interior of the molding box 1 through a feeding pipe 5. An air outlet opening 51 of the molding box 1 is installed suitably below the model 2, in a side wall of the molding box 1, or preferably, in the bottom of the molding box 1.

In the embodiment shown in FIG. 1, the side walls of the molding box 1 are provided with a plurality of air outlet openings 51 and are surrounded by a manifold 52 so that the negative pressure becomes effective, rapidly and uniformly within molding box 1. Several manifolds 52 can also be installed at different levels, which are then consecutively subjected to negative pressure in function of the filling level.

In another embodiment a manifold 52, capable of being adjusted in height can be provided. The molding sand is filled into the molding box 1 from a sand supply device 6 via a valve 61 into molding box 1.

Surprisingly, the subjection of the sand to negative pressure during filling of the molding box with sand, causes the sand to also rise into the crucial cavities 20 of model 2 or of other molding types that had been excluded from the full mold casting process until now. As experience has shown in the meantime, the filling of the crucial cavities with sand and the hardening of the latter are especially reliable when a negative pressure of 0.5 bar is applied, and when the negative pressure is brought into the molding box below model 2, especially through the bottom of the molding box 1.

It has been found to be necessary to maintain the negative pressure during the filling process until the sand within the molding box reaches the level required for filling the cavities 20. After the cavities 20 has been filled, the negative pressure may be reduced or turned off.

Figures 2, 3A, 3B, 3C:
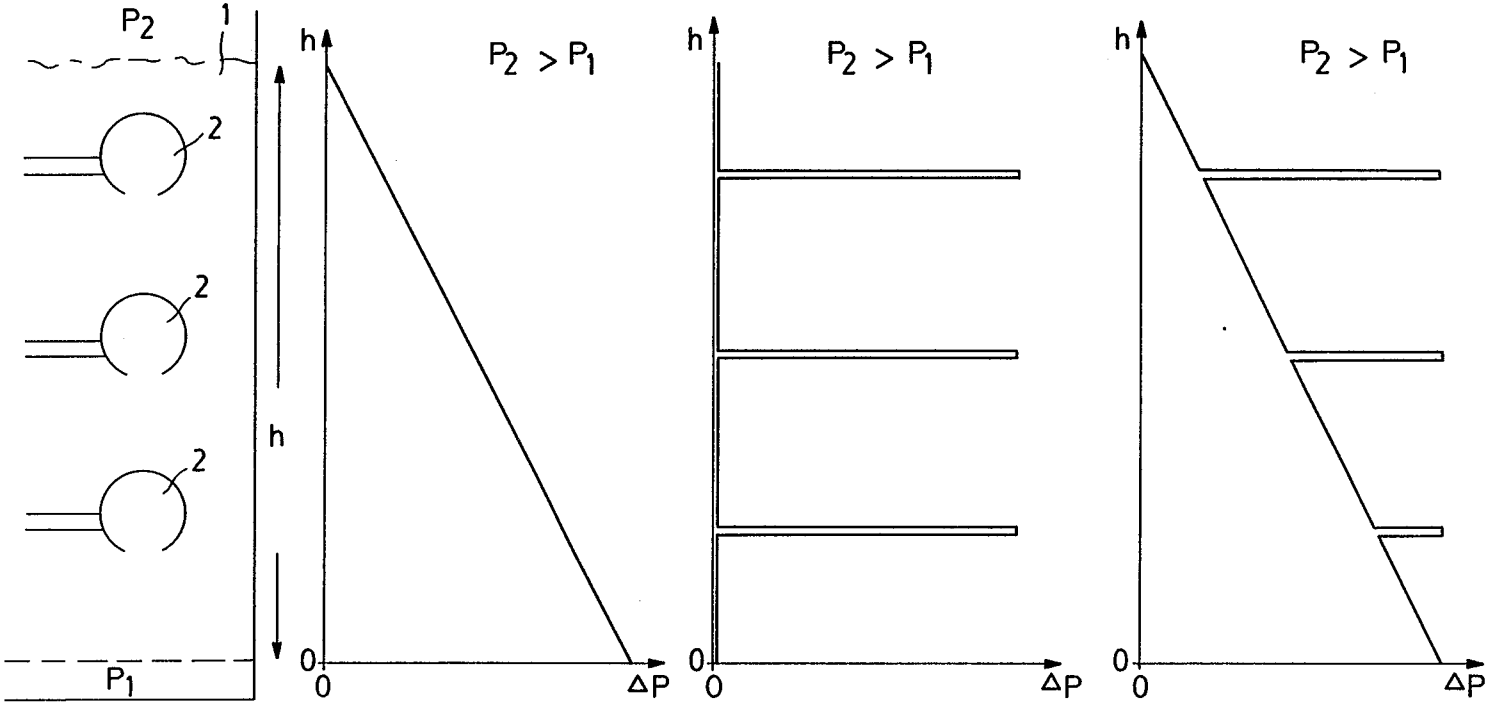
FIG. 2 illustrates schematically the molding box with a plurality of models.
FIG. 3*a* illustrates graphically the reduction in the negative pressure as the sand level rises in the molding box.
FIG. 3*b* illustrates graphically the empty molding box with a plurality of models.
FIG. 3*c* illustrates graphically the negative pressure reduction in the molding box having a plurality of models as the molding box fills with sand.

As seen in FIG. 2, it is possible to fill a plurality of models 2 in molded box 1 at the same time.

In view of the fact that the negative pressure reacts against the vibrating tempering-end force, it is also possible, while subjecting the sand to a negative pressure during the entire filling process to reduce the negative pressure as the filling level rises in the molded box as illustrated graphically in FIG. 3*a*. To determine the pressure levels experience indicates the maximum value at the low filling levels necessary to repress the fluidizations of the sand and to achieve the hardening of the sand. In order to insure that the cavities 20 of the model 2 are filled with sand, the negative pressure within the molding box is brought to the level required.

It is also essential for the reliable and complete filling of the cavities 20, for the air, and with it the sand it entrains, to flow into cavities 20. This flow is assured by maintaining the filling level of the molding sand substantially constant near the cavities 20 during the filling process. As seen in FIG. 1, the flow path (indicated by the arrows) flows upwardly from the surface of the sand into cavity 20. The feeding of the sand into the molding box can be interrupted when the level of the model or the highest model is reached so that the flow path is not buried until cavity 20 is completely filled with the sand. In the alternative, when more than one model or sets of models are filled within the same molding box, the sand can be deposited at a different location without interruption after the cavity 20 of one model is filled, by the use of suitable indexing means not shown.

By tamping in the sand during its subjection to negative pressure, the filling of cavity 20 is assisted and facilitated. It is also possible to apply vibration without negative pressure before applying vibratin with negative pressure. However, this should be avoided after the application of vibration with negative pressure because of the danger that the hardened sand may be loosened again by vibration alone. Negative pressure is therefore maintained at least until the vibration is ended.

The operation of the negative pressure device and of the sand feeding device 6, in the manner described for the process, can be effected manually or by means of a control device, for example one as shown schematically in FIG. 1.

As seen in FIG. 1 the molded box 1 is equipped with a transducer 7 which transmits a signal to a microprocessor 71 whenever the sand reaches a predetermined depth within molding box 1. Microprocessor 71 is connected to a negative pressure forming device 50, and to a measuring link 53 which regulates the negative pressure exerted on the molded box as a function of the filling level of the molded box and turns the negative pressure off completely when the level of the model is attained and the cavity 20 is completely filled. Furthermore, the feeding the sand into molding box 1 through valve 61 is also controlled by the microprocessor 71 which ceases to feed sand into the box whenever the sand level has reached the level determined to be necessary for the filling of cavities 20.

As seen graphically in FIG. 3*a*, the degree of negative pressure is reduced progressively as the molding box 1 is filled with sand.

FIG. 2 illustrates graphically the empty box with a plurality of mold models therein and FIG. 3 illustrates graphically the filling of the molding box with sand when a plurality of models are used as shown in FIG. 2. This figure also illustrates the reduction of the negative pressure in the molding box as the sand level rises within the box. Thus, it will be noted that less pressure is needed to fill the cavity of the top most model 2 as the level of the sand within the molding box increases.

The microprocessor 71 can, furthermore, be connected to the vibrating device 4 for control purposes. In the same manner, appropriate information can be given to the microprocessor 71 when a molding sand of different type, with different hardening characteristics, is used, e.g. information concerning the level of negative pressure to be applied in that case.

What is claimed is:

1. A full mold metal casting process, comprising the following steps:

(a) supporting at least one model which is composed of a thermally decomposable material which has at least one cavity therein and which has only one opening on a lower surface of said model, within a molding box above the bottom of said molding box;

(b) filling said box with sand until it reaches the level of said opening in said model;

(c) maintaining the level of said sand at the level of said opening until said cavity is filled with sand;

(d) creating a pressure differential wherein the pressure in said sand is different than the pressure outside of said sand to cause said sand to flow into, and to fill said cavity; and (e) maintaining said pressure differential and the level of said sand constant until said cavity is filled so that the flow path of the sand into said cavity is not submerged in the sand itself until said cavity is completely filled.

2. A full mold metal casting process as set forth in claim 1, wherein said pressure differential is created by subjecting said sand to a negative pressure during the filling of said molding box and the model to create and maintain a lower pressure within said sand.

3. A full mold metal casting process as set forth in claim 1, wherein the atmosphere within said molding box, above the level of said sand is subjected to a positive pressure during the filling of said box and mold cavity so as to maintain a lower pressure within said sand.

4. A full mold metal casting process as set forth in claim 1, including the step of vibrating said molding box to tamp said sand into said molding box and said cavity of said model while filling said box with sand.

5. A full mold metal casting process as set forth in claim 2, including the step of vibrating said molding box at the same time said sand is subjected to said negative pressure.

6. A full mold metal casting process as set forth in claim 5, wherein said negative pressure is maintained while said box is vibrating.

7. A full mold metal casting process as set forth in claim 2, wherein said negative pressure is introduced into said molding box at a point which is lower than said model.

8. A full mold metal casting process as set forth in claim 7, wherein said negative pressure is introduced into said molding box through the bottom of said box.

9. A full mold metal casting process as set forth in claim 2, wherein the level of negative pressure is determined as a function of the type of sand used.

10. A full mold metal casting process as set forth in claim 2, wherein the negative pressure is descreased as the filling level of said sand increases.

11. A full mold metal casting process as set forth in claim 2, wherein said negative pressure is brought to the degree predetermined necessary to fill the cavity of the model when the level of the opening in said model is reached by the sand during said filling operation.

12. A full mold metal casting process as set forth in claim 1, wherein said sand is free of a binding agent.

13. A full mold metal casting device, comprising:

(a) a molding box for holding sand;

(b) means for supporting a positive model composed of a thermally decomposable material which has only one cavity opening in a lower surface of said model at a level above the bottom of said box;

(c) means for filling said box with sand to the level of said opening in said cavity;

(d) means for creating a pressure differential wherein the pressure within said sand is lower than the pressure within said box above said sand; and (e) control means for controlling and maintaining the level of said sand at the level of said opening, and for maintaining said pressure differential until said cavity is filled so that the flow path of sand into said cavity is not submerged until said cavity is completely filled with sand.

14. A full mold metal casting device as set forth in claim 13, wherein said molding box is provided with a plurality of openings below the level at which said support means supports said positive model, and said openings are connected to a negative pressure device by means of a manifold which surrounds said openings.

15. A full mold metal casting device as set forth in claim 13, wherein means are provided for creating a positive pressure within said molding box above the upper surface of said sand.

16. A full mold metal casting device as set forth in claim 14, wherein said openings are located at a point between the level at which said model is supported and the bottom of said molding box.

17. A full mold metal casting device as set forth in claim 14, wherein said openings are located in the bottom of said molding box.

18. A full mold metal casting device as set forth in claim 13, wherein said control means includes means for varying the pressure differential during the filling of said cavity.

* * * * *